US009458725B2

(12) United States Patent
Morgan et al.

(10) Patent No.: US 9,458,725 B2
(45) Date of Patent: Oct. 4, 2016

(54) METHOD AND SYSTEM FOR PROVIDING COOLING FOR TURBINE COMPONENTS

(71) Applicant: General Electric Company, Schenectady, NY (US)

(72) Inventors: Victor John Morgan, Simpsonville, SC (US); John Wesley Harris, Jr., Taylors, SC (US); Michael James Healy, Greenville, SC (US); Aaron Ezekiel Smith, Simpsonville, SC (US); Brian Gene Brzek, Clifton Park, NY (US); Donald Earl Floyd, II, Greenville, SC (US)

(73) Assignee: General Electric Company, Schenectady, NY (US)

( * ) Notice: Subject to any disclaimer, the term of this patent is extended or adjusted under 35 U.S.C. 154(b) by 491 days.

(21) Appl. No.: 14/046,437

(22) Filed: Oct. 4, 2013

(65) Prior Publication Data

US 2015/0096305 A1 Apr. 9, 2015

(51) Int. Cl.

| | |
|---|---|
| ***F01D 9/02*** | (2006.01) |
| ***F01D 5/18*** | (2006.01) |
| ***F01D 9/06*** | (2006.01) |

(52) U.S. Cl.

CPC ..... *F01D 5/18* (2013.01); *F01D 5/186* (2013.01); *F01D 5/187* (2013.01); *F01D 9/065* (2013.01); *F01D 5/183* (2013.01); *F05D 2230/21* (2013.01); *F05D 2230/90* (2013.01); *F05D 2240/122* (2013.01); *F05D 2260/202* (2013.01); *F05D 2260/204* (2013.01); *F05D 2260/22141* (2013.01); *F05D 2300/612* (2013.01)

(58) Field of Classification Search

CPC ..... F01D 5/18; F01D 5/186; F01D 5/187; F05D 2230/237; F05D 2230/90; F05D 2240/122; F05D 2260/22141; F05D 2230/21

See application file for complete search history.

(56) References Cited

U.S. PATENT DOCUMENTS

| | | | | |
|---|---|---|---|---|
| 5,626,462 | A | 5/1997 | Jackson et al. | |
| 5,820,337 | A | 10/1998 | Jackson et al. | |
| 5,957,657 | A | 9/1999 | Akita et al. | |
| 6,602,047 | B1 | 8/2003 | Barreto et al. | |
| 6,638,639 | B1 | 10/2003 | Burke et al. | |
| 6,890,154 | B2 | 5/2005 | Cunha | |
| 7,008,179 | B2 | 3/2006 | Rinck et al. | |
| 7,080,971 | B2 * | 7/2006 | Wilson | F01D 5/147 416/92 |
| 7,867,628 | B2 * | 1/2011 | Ozbaysal | B23K 35/0238 416/229 R |
| 7,900,458 | B2 | 3/2011 | James et al. | |
| 8,210,815 | B2 | 7/2012 | Bezencon et al. | |
| 8,348,614 | B2 | 1/2013 | Piggush et al. | |
| 8,714,909 | B2 * | 5/2014 | Propheter-Hinckley | F01D 9/041 415/115 |
| 8,734,111 | B2 * | 5/2014 | Lomas | F01D 5/187 416/193 A |
| 2011/0110771 | A1 | 5/2011 | Morgan et al. | |
| 2012/0201653 | A1 * | 8/2012 | Moga | F01D 5/147 415/115 |

* cited by examiner

*Primary Examiner* — Ninh H Nguyen

(74) *Attorney, Agent, or Firm* — Armstrong Teasdale LLP

(57) ABSTRACT

A method and system for providing cooling of a turbine component that includes a region to be cooled is provided. A recess is defined within the region to be cooled, and includes an inner face. At least one support projection extends from the inner face. The at least one support projection includes a free end. A cover is coupled to the region to be cooled, such that an inner surface of the cover is coupled to the free end of the at least one support projection, such that at least one cooling fluid passage is defined within the region to be cooled.

20 Claims, 6 Drawing Sheets

METHOD AND SYSTEM FOR PROVIDING COOLING FOR TURBINE COMPONENTS

BACKGROUND OF THE INVENTION

This invention relates generally to turbomachinery, and, more specifically, to methods and systems for providing cooling for internal structures of gas turbine components.

In at least some known gas turbines, an internal structure of a component that is exposed to hot combustion gases is cooled using a cooling fluid that is channeled through passages defined within the component. In components such as stator vanes and rotor blades that extend substantially radially with respect to an axis of a gas turbine, at least some of the cooling passages likewise extend substantially radially. At least some further passages extend below and substantially parallel to at least a portion of an outer surface of the component. Cooling fluid is supplied to the passages from a source of cooling fluid coupled to the component.

Moreover, in at least some known gas turbines that include multiple rotor and stator stages, trailing-edge areas of airfoils of first-stage stator nozzle vanes, and first-stage rotor blades as well, experience temperatures and corresponding thermal loads that are amongst the highest that are encountered within a gas turbine. Accordingly, there is a tendency for a designer to increase a thickness of an airfoil, to provide a structural volume that is sufficiently large to facilitate defining cooling passages therein. However, there is a competing pressure on designers to reduce airfoil thickness, particularly in the trailing-edge areas, as trailing-edge thickness is a factor that exerts significant influence on aerodynamic efficiency of an airfoil.

Accordingly, it is desirable to improve airfoil aerodynamic efficiency by reducing trailing-edge thickness, while simultaneously facilitating enhanced cooling of trailing-edge structures.

BRIEF DESCRIPTION OF THE INVENTION

In one aspect, a method for providing a cooling system for a turbine component is provided. The method includes defining a turbine component body, wherein the turbine component body includes a region to be cooled. The method also includes defining a recess within the region to be cooled, wherein the recess includes an inner face. The method also includes defining at least one support projection extending from the inner face, wherein the at least one support projection includes a free end. The method also includes coupling a cover to the region to be cooled of the turbine component body, such that an inner surface of the cover is coupled to the free end of the at least one support projection, such that at least one cooling passage is defined within the region to be cooled.

In another aspect, a system for providing cooling of a turbine component is provided. The system includes a turbine component body that includes a region to be cooled. The system also includes a recess defined within the region to be cooled, wherein the recess includes an inner face. The system also includes at least one support projection extending from the inner face, wherein the at least one support projection includes a free end. The system also includes a cover coupled to the region to be cooled of the turbine component body, such that an inner surface of the cover is coupled to the free end of the at least one support projection, such that at least one cooling fluid passage is defined within the region to be cooled.

In still another aspect, a gas turbine system is provided. The gas turbine system includes a compressor section. The gas turbine system further includes a combustion system coupled in flow communication with the compressor section. The gas turbine system also includes a turbine section coupled in flow communication with the combustion system. The turbine section includes a turbine component body that includes a region to be cooled. The turbine section also includes a recess defined within the region to be cooled, wherein the recess includes an inner face. The turbine section also includes at least one support projection extending from the inner face, wherein the at least one support projection includes a free end. The turbine section also includes a cover coupled to the region to be cooled, such that an inner surface of the cover is coupled to the free end of the at least one support projection, such that at least one cooling fluid passage is defined within the region to be cooled.

DETAILED DESCRIPTION OF THE INVENTION

As used herein, the terms "axial" and "axially" refer to directions and orientations extending substantially parallel to a longitudinal axis of a gas turbine engine. Moreover, the terms "radial" and "radially" refer to directions and orientations extending substantially perpendicular to the longitudinal axis of the gas turbine engine. In addition, as used herein, the terms "circumferential" and "circumferentially" refer to directions and orientations extending arcuately about the longitudinal axis of the gas turbine engine.

Figure 1:
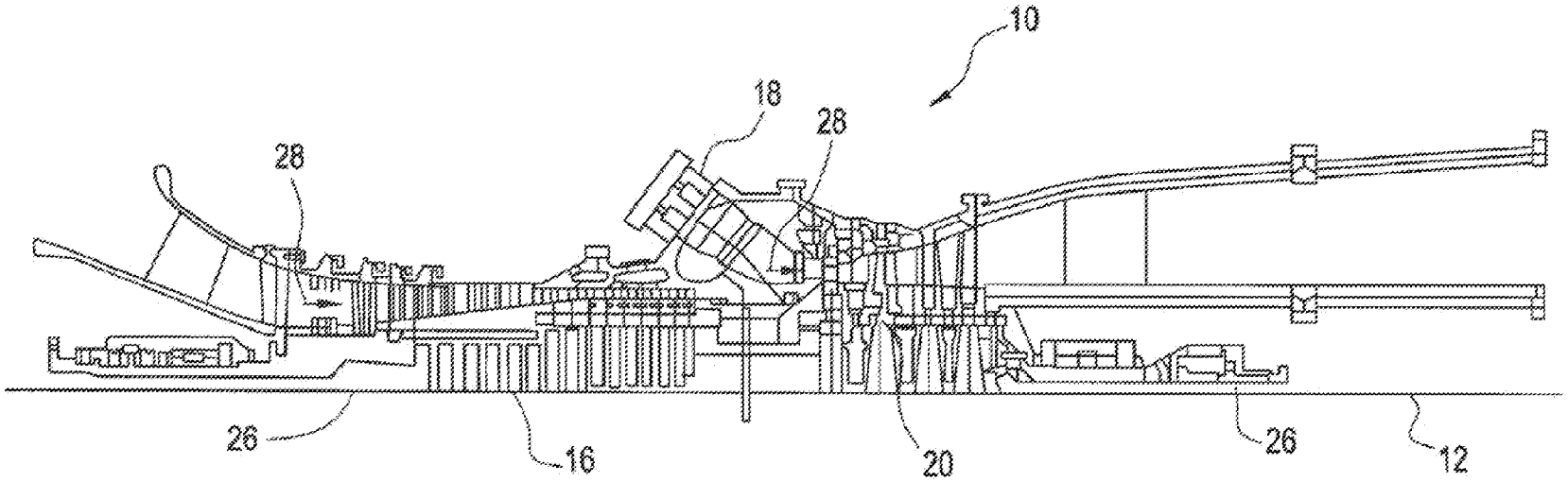
FIG. 1 is a schematic illustration of a gas turbine engine, in which an exemplary cooling method and system may be used.

FIG. 1 illustrates a gas turbine system 10 in which exemplary trailing-edge cooling systems may be implemented. The exemplary trailing-edge cooling systems described herein have been described with respect to a gas turbine. In other exemplary embodiments, the trailing-edge cooling systems described herein can be implemented with other systems in which heat protection and dissipation are desirable such as, but not limited to, steam turbines and compressors. Gas turbine system 10 is illustrated circumferentially disposed about an engine centerline 12. Gas turbine system 10 can include, in serial flow relationship, a compressor 16, a combustion system 18 and a turbine 20. Combustion system 18 and turbine 20 are often referred to as the hot section of gas turbine system 10. A rotor shaft 26 rotationally couples turbine 20 to compressor 16. Fuel is burned in combustion system 18 producing a hot gas flow 28, for example, which can be in the range between about 3000 to about 3500 degrees Fahrenheit. Hot gas flow 28 is directed through turbine 20 to power gas turbine system 10.

Figure 2:
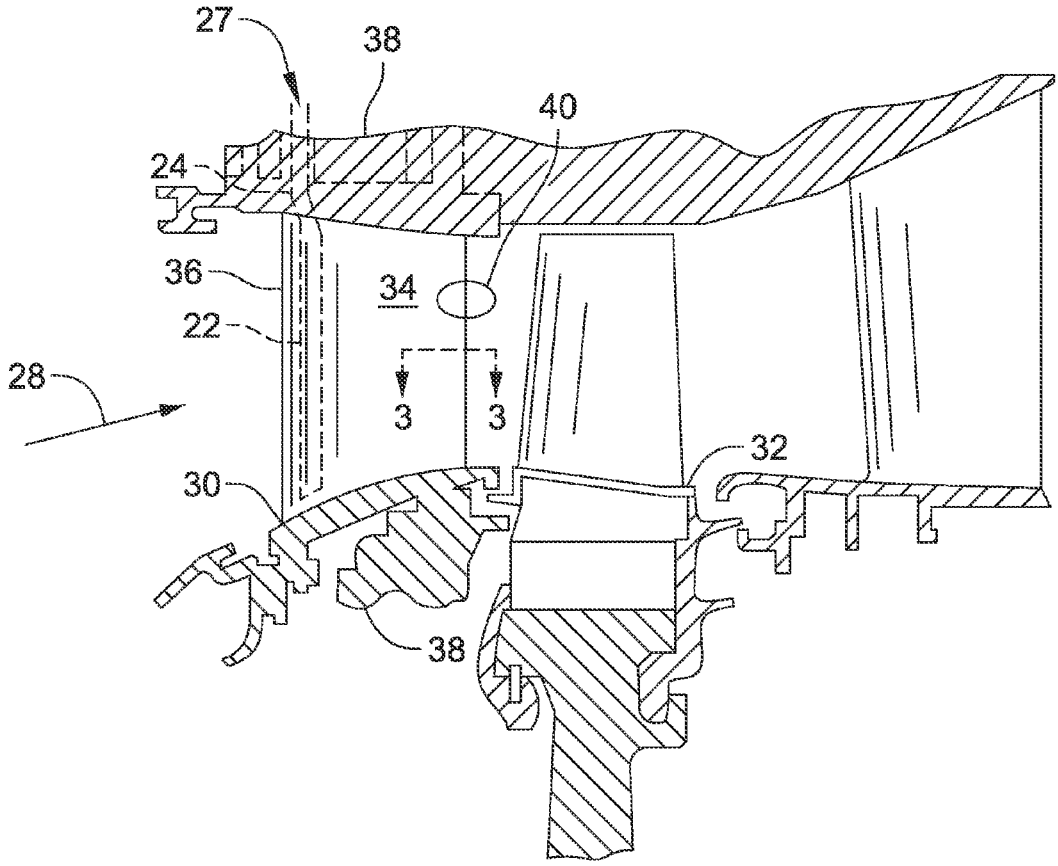
FIG. 2 is an enlarged schematic side sectional view of a turbine portion of the gas turbine engine illustrated in FIG. 1.

FIG. 2 illustrates turbine 20 of FIG. 1. Turbine 20 can include a stator vane 30 and a turbine blade 32. An airfoil 34 is provided for vane 30. Vane 30 has a leading edge 36 that is exposed to hot gas flow 28. Stator vanes 30 may be cooled by air routed from one or more stages of compressor 16 through a casing 38 of system 10.

Figure 3:
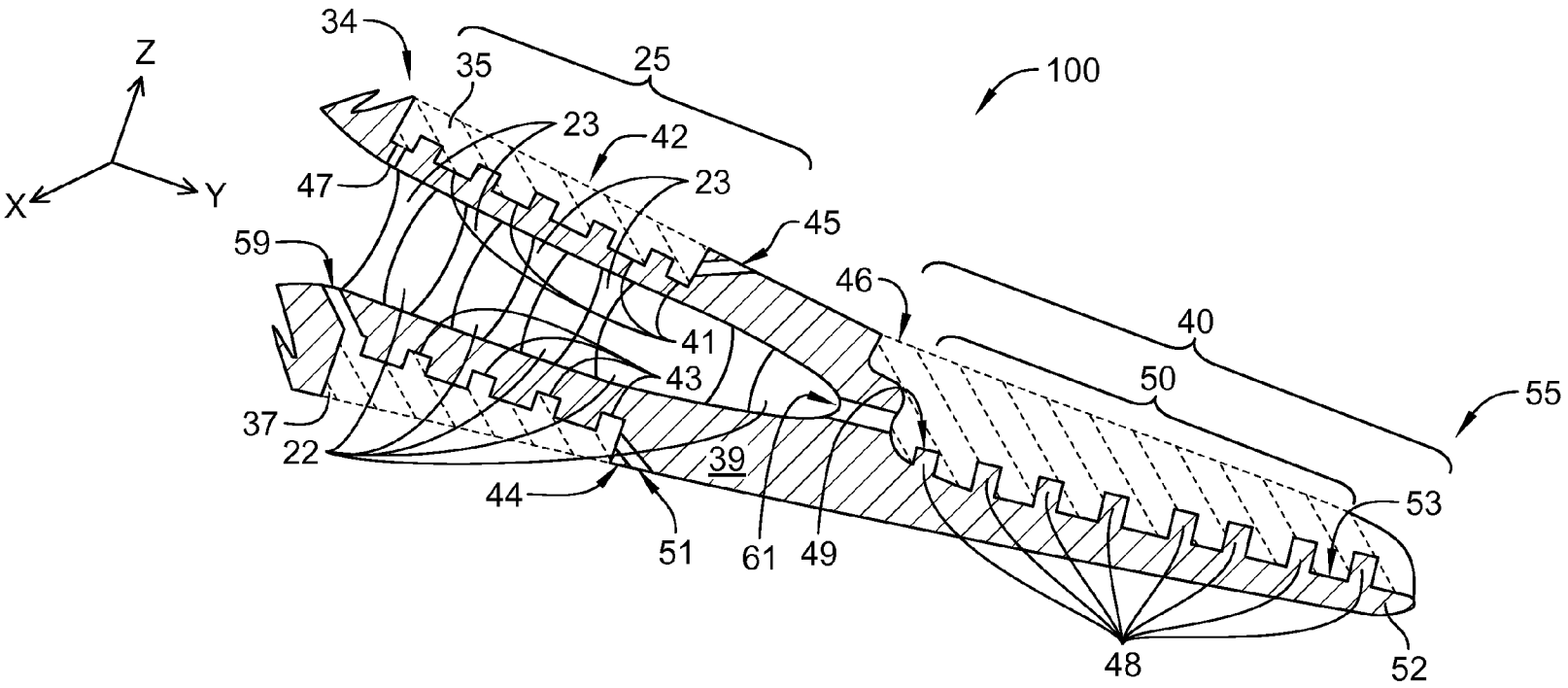
FIG. 3 is an enlarged sectional view illustrating a preliminary step of an exemplary method for defining a trailing-edge cooling system.
Figure 4:
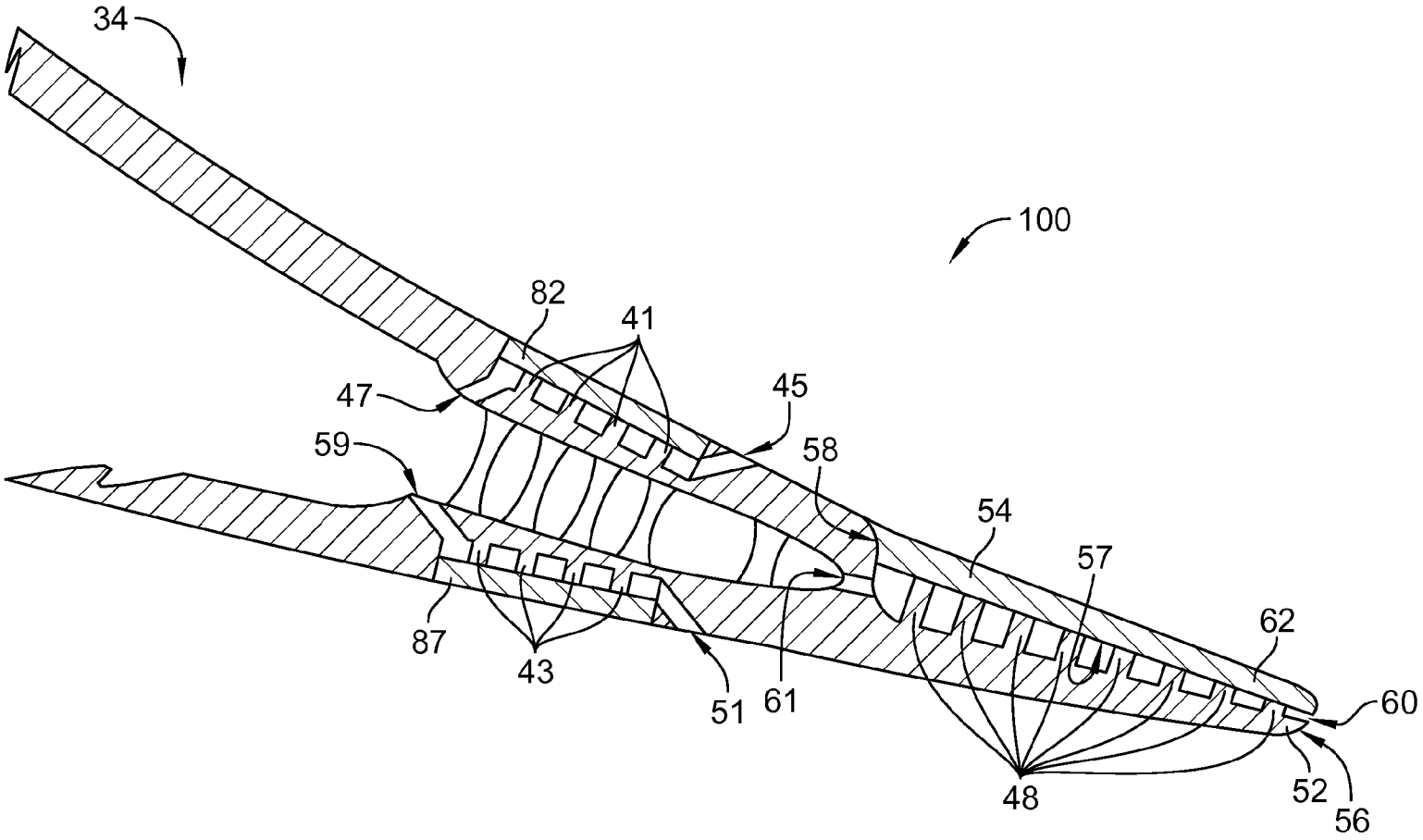
FIG. 4 is an enlarged sectional view illustrating an intermediary step of an exemplary method for defining a trailing-edge cooling system.
Figure 5:
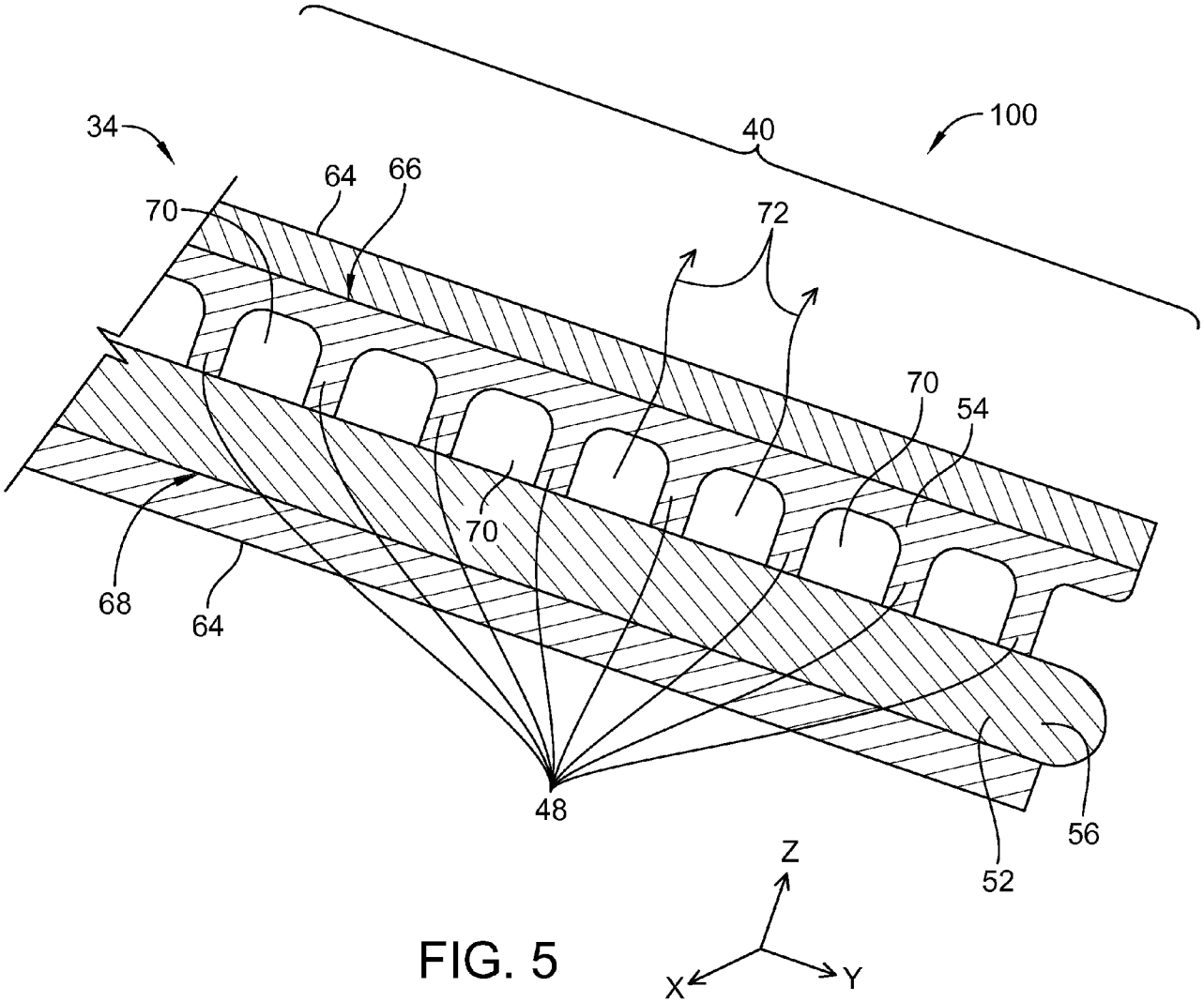
FIG. 5 is an enlarged sectional view illustrating an airfoil trailing-edge after completion of an exemplary method for defining a trailing-edge cooling system.

FIGS. 3-5 illustrate a trailing-edge cooling system 100 for use in a trailing-edge region 40 of airfoil 34. In the exemplary embodiment, air is used as the cooling fluid used in trailing-edge cooling system 100. Although air is specifically described, in alternative embodiments a fluid other than air is used to cool components exposed to combustion gases. It should also be appreciated that the term "fluid" as used herein includes any medium or material that flows, including, but not limited to, gas, steam, and air. In at least some known turbines 20, at least one cooling passage 22 is defined in stator vane 30. Cooling passage 22 is coupled a cooling supply passage 24 defined in a casing 38 of system 10 which, in turn, is coupled to a source 27 of cooling fluid.

FIG. 3 is an enlarged sectional view of an exemplary trailing-edge region 40 of airfoil 34, illustrating a preliminary step of an exemplary method for defining trailing-edge cooling system 100. Specifically, FIG. 3 is a sectional view along a direction parallel to a longitudinal axis X of airfoil 34, wherein axis X extends substantially radially with respect to engine centerline 12. An axis Y represents a chord-wise direction relative to airfoil 34, wherein "chord-wise" refers to a direction from leading edge 36 (shown in FIG. 2) to trailing-edge region 40. An axis Z defines a thickness direction relative to airfoil 34. Moreover, FIG. 3 illustrates an airfoil body 39, of which trailing-edge region 40 provides a location for implementation of cooling system 100. Airfoil body 39 includes a suction side 44 and a pressure side 42. As described, in the exemplary embodiment, airfoil body 39 is fabricated via a casting process. In alternative embodiments, airfoil body 39 is fabricated using any suitable fabrication method sufficient to enable exemplary cooling system 100 to function as described herein. Airfoil body 39 includes cooling passages 22. In the exemplary embodiment, passages 22 are defined by support projections or pins 23 which, in turn, are defined during casting of airfoil body 39. However, the creation of pins 23, which are monolithically defined as integral components of airfoil body 39, is limited to thicker regions 25 of airfoil body 39, due to physical dimensional (or spatial) limitations of known casting processes. Similar spatial limitations apply to alternative airfoil fabrication techniques, such as machining. The exemplary cooling system 100 addresses such spatial limitations to provide internal cooling passages, in a direction parallel to axis Z of airfoil body 39, within trailing-edge region 40, being the thinnest region of airfoil body 39.

After casting, trailing-edge region 40 of airfoil body 39 includes a sacrificial region 46 (shown in broken lines). Material within sacrificial region 46 is removed, using any suitable material-removal method, including but not limited to cutting tool-based machining and/or milling, EDM (electrical discharge machining), water machining, laser machining, and/or any other material removal method that enables system 100 to function as described herein.

Removal of material from sacrificial region 46 defines a plurality of individual support projections or pins 48, collectively referred to as a pin-bank 50, extending from an inner face 53 of a recess or lip 52. Pins 48 project outwardly from lip 52 of trailing-edge region 40. In the exemplary embodiment, pins 48 are monolithically defined with lip 52. In the exemplary embodiment, pins 48 have any suitable cross-sectional configuration, spacing, and dimensions that enable system 100 to function as described herein. Although eight pins 48 are shown in FIG. 3, in alternative embodiments, more or less pins 48 are used. A single row of pins 48 extending substantially along axis Y is shown in FIG. 3. In the exemplary embodiment, a plurality of rows of pins 48, arranged along axis X, is provided. In some exemplary embodiments, pins 48 in adjacent rows are aligned with each other. In other alternative embodiments, pins 48 in adjacent rows are not aligned with each other. In the exemplary embodiment, pins 48 are defined following removal of material from sacrificial region 46, which results in a notch 55 within trailing-edge region 40 that is defined by shoulder 58 and tip 56.

In an alternative embodiment, pins 48 are defined during the initial casting process of defining airfoil body 39. More specifically, if defined by casting, trailing-edge region 40 is initially cast as a notch 55 bounded by shoulder 58 and tip 56, with pins 48 cast in situ, projecting away from inner face 53. In so doing, pins 48 are arranged on inner face 53 in any pattern suitable that enables system 100 to function as described herein. In the exemplary embodiment, whether pins 48 are defined by material removal, casting, or other method, each pin 48 is defined with a free end 49.

FIG. 4 is an enlarged sectional view of airfoil trailing-edge region 40 shown in FIG. 3, illustrating an intermediary step of an exemplary method for defining a trailing-edge cooling system 100, after removal of sacrificial region 46. A layer (or "cover") 54 of a pre-sintered preform ("PSP") braze material is shaped, using any suitable method, to fit over pins 48, and substantially aligned with a tip 56 of lip 52 and a shoulder 58, when layer 54 is positioned ("juxtaposed") substantially over and against pins 48. After positioning of layer 54, an inner surface 57 (illustrated in FIG. 4) of layer 54 is in actual contact with a free end 49 of one or more of pins 48, or is spaced a small distance apart from a free end 49 of one or more of pins 48. In the exemplary embodiment, layer 54 is fabricated from any suitable material that enables system 100 to function as described herein. More specifically, in the exemplary embodiment, layer 54 is fabricated as a mixture of at least one high-temperature metal powder and at least one low-temperature metal powder. The high- and low-temperature powders are sintered together to define layer 54. After placement of layer 54 onto pins 48, airfoil body 39 is heated, using any suitable process that enables layer 54 to bond with pins 48 and shoulder 58 in a manner sufficient to enable system 100 to function as described herein. Prior to heating, a gap 60 exists between tip 56 and a tip 62 of layer 54. Following heating, gap 60 remains and serves as an exhaust opening extending along trailing edge region 40 between tips 56 and 62. During turbine operation, cooling air enters pin-bank 50 via an inlet 61.

FIG. 5 is an enlarged sectional view of the airfoil trailing-edge region 40 shown in FIG. 3, after completion of an exemplary method for defining a trailing-edge cooling system 100. As described, in the exemplary embodiment, heating of airfoil body 39 causes PSP braze layer 54 to close gap 60 (shown in FIG. 4), to couple with tip 56 of lip 52. Similarly, PSP braze layer 54 is coupled to airfoil body 39 at shoulder 58. A layer 64 of thermal bond coat ("TBC") is coupled to an outer surface 66 of layer 54 and to an outer surface 68 of lip 52. In the exemplary embodiment, TBC layer 64 is fabricated in any suitable manner sufficient to enable completed airfoil 34 to function as described.

Pins 48 define a plurality of gaps 70 which, together with similar gaps in adjacent rows of pins 48 (not shown) define a plurality of flow paths 72 through airfoil 34. In the exemplary embodiment, flow paths 72 are coupled to cooling supply passage 24, to provide cooling fluid to trailing-edge region 40 of airfoil 34.

The exemplary embodiment illustrated in FIGS. 3-5 includes pin-bank 50, which is located in trailing-edge region 40 on pressure side 42 of airfoil body 39. In addition to locating a pin-bank 50 at lip 52, other locations may be used, such as at sacrificial region 35, located on pressure side 42 and/or at sacrificial region 37, located on suction side 44 (illustrated in FIGS. 3-4). Removal of material from sacrificial region 35, using any of the methods described herein, defines a recess into which pins 41 project. Likewise, removal of material from sacrificial region 37 defines pins 43. Following material removal, a PSP braze material layer 82 is fitted against pins 41, and fastened thereto, such as by heating, as described herein. Likewise, a PSP braze material layer 87 can be fitted against pins 43, and fastened thereto, such as by heating, as described herein. Thereafter, layers 82 and/or 87 can be covered, such as by TBC layer 64 (shown in FIG. 5). To accommodate air flow past pins 41 and/or 43, airfoil body 39 has defined therein cooling air inlets 47 and 59, and exhaust outlets 45 and 51. Air discharged from outlets 45 and/or 51 defines cooling air film(s) for further cooling of airfoil body 39.

Figure 6:
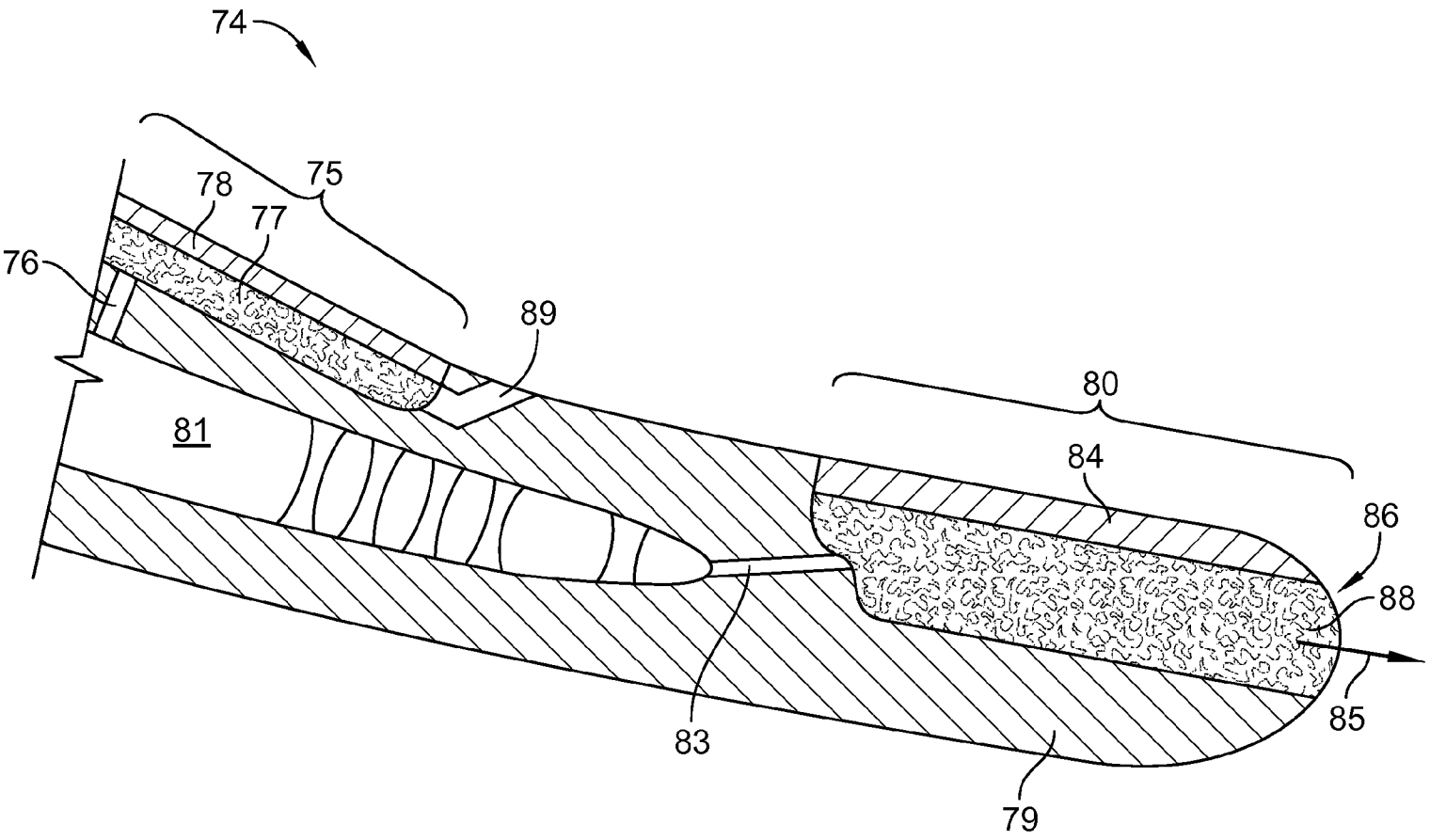
FIG. 6 is an enlarged sectional view illustrating an airfoil trailing-edge after completion of an alternative exemplary method for defining a trailing-edge cooling system.

FIG. 6 is an enlarged sectional view illustrating an airfoil 74 including an airfoil trailing-edge region 80 after completion of an alternative exemplary method for defining a trailing-edge cooling system. Instead of defining individual pins 41 (shown in FIGS. 3-5), removal of material from trailing-edge region 80 defines a lip 79. A layer 88 of porous metal foam material is applied to lip 79. A PSP braze layer 84 is applied to porous metal foam layer 88, such that layer 88 projects from lip 79 and supports layer 84. Airfoil 74 is heated, as described herein, causing braze layer 84 to be fastened to porous metal foam layer 88, and further causing porous metal foam layer 88 to be fastened to lip 79. Porous metal foam layer 88 remains porous after heating. In an alternative embodiment, porous metal foam is used instead of pins at other locations, such as at region 75. After removal of material from region 75 using any of the material removal methods described herein, a porous metal foam layer 77 is inserted and covered by a PSP braze layer 78.

During turbine operation, cooling air from an interior cooling air plenum 81 is channeled into porous metal foam layer 88 via an inlet 83 and defines a cooling air exhaust 85 at an exhaust region 86 defined between lip 79 and braze layer 84. Likewise, cooling air from plenum 81 is channeled into porous metal foam layer 77 via an inlet 76, and exhausted from porous metal foam layer 77 via an exit opening 89.

The invention described herein provides several advantages over known systems and methods for providing cooling of turbine trailing-edge structures. Specifically, the systems described herein facilitate defining cooling passages within trailing-edge regions of airfoils, in particular in relatively thin areas of airfoils near or at the actual trailing-edge of the airfoil. Moreover, the systems described herein facilitate the defining of cooling passages in areas of an airfoil that are not amenable to other methods for defining cooling passages, such as casting. Specifically, the systems described herein address spatial limitations to provide internal cooling passages within a trailing-edge region of an airfoil. In addition, the systems described herein facilitate defining a pin-bank such that the pins are located in any desired pattern, size, shape and/or spacing suitable to enable the cooling passages to function as described herein.

Exemplary embodiments of a method and a system for providing cooling of turbine components are described above in detail. The method and system are not limited to the specific embodiments described herein, but rather, components of systems and/or steps of the methods may be utilized independently and separately from other components and/or steps described herein. For example, the method may also be used in combination with other turbine components, and are not limited to practice only with the gas turbine nozzle vanes as described herein. Rather, the exemplary embodiment can be implemented and utilized in connection with many other gas turbine applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention can be practiced with modification within the spirit and scope of the claims.

What is claimed is:

1. A method for providing a cooling system for a turbine component, wherein said method comprises:

defining a turbine component body, wherein the turbine component body includes a region to be cooled;

defining a recess within the region to be cooled, wherein the recess includes an inner face;

defining at least one support projection extending from the inner face, wherein the at least one support projection includes a free end;

coupling a cover to the region to be cooled, such that an inner surface of the cover is coupled to the free end of the at least one support projection, to define at least one cooling passage within the region to be cooled; and coupling at least one of a bond coat and a thermal barrier coat to the cover.

2. A method in accordance with claim 1, wherein said method comprises coupling the at least one cooling passage within the region to be cooled in flow communication with a source of cooling fluid.

3. A method in accordance with claim 1, wherein defining a recess within the region to be cooled comprises:

removing a volume of sacrificial material from the region to be cooled, wherein the region to be cooled extends from a tip of a trailing-edge region of the turbine component body to a location spaced a distance from the trailing-edge tip; and defining a shoulder at the location spaced a distance from the trailing-edge tip.

4. A method in accordance with claim 1, wherein defining at least one support projection comprises defining the at least one support projection to extend from the inner face in a direction substantially perpendicular to the inner face of the recess.

5. A method in accordance with claim 1, wherein defining at least one support projection comprises defining a plurality of support projections extending from the inner face.

6. A method in accordance with claim 1, wherein coupling a cover comprises:

locating a layer of braze material in juxtaposition with the free end of the at least one support projection; and heating the braze material and the component body such that the layer of braze material couples to the free end of the at least one support projection.

7. A method in accordance with claim 6, wherein said method comprises coupling the bond coat to the layer of braze material.

8. A method in accordance with claim 7, wherein said method comprises coupling the thermal barrier coat to the bond coat.

9. A method in accordance with claim 1, wherein defining at least one support projection extending from the inner face comprises one of:

selectively removing material from the region to be cooled to define at least one pin; and positioning a layer of porous metal foam material within the recess.

10. A system for providing cooling of a turbine component, said system comprising:

a turbine component body that includes a region to be cooled;

a recess defined within said region to be cooled, wherein said recess includes an inner face;

at least one support projection extending from said inner face, wherein said at least one support projection includes a free end;

a cover coupled to said region to be cooled, such that an inner surface of said cover is coupled to said free end of said at least one support projection, such that at least one cooling fluid passage is defined within said region to be cooled; and at least one of a bond coat and a thermal barrier coat coupled to said cover.

11. A system in accordance with claim 10, wherein said system comprises a source of cooling fluid coupled to said at least one cooling fluid passage.

12. A system in accordance with claim 10, wherein said recess comprises:

said inner face extending from a tip of a trailing-edge region to a location spaced a distance from said trailing-edge tip; and a shoulder defined at said location spaced a distance from said trailing-edge tip.

13. A system in accordance with claim 10, wherein said at least one support projection extends from said inner face in a direction substantially perpendicular to said inner face.

14. A system in accordance with claim 10, wherein said at least one support projection comprises a plurality of support projections extending from said inner face.

15. A system in accordance with claim 10, wherein said cover comprises a layer of braze material coupled to said free end of said at least one support projection.

16. A system in accordance with claim 15, wherein said system comprises said bond coat coupled to said layer of braze material.

17. A system in accordance with claim 16, wherein said system comprises said thermal barrier coat coupled to said bond coat.

18. A gas turbine system, said gas turbine system comprising:

a compressor section;

a combustion system coupled in flow communication with said compressor section; and a turbine section coupled in flow communication with said combustion system, wherein said turbine section comprises:

an airfoil of a turbine component, said airfoil comprising a surface positioned to be in contact with a hot gas flow path of said gas turbine system, said airfoil further comprising a region to be cooled adjacent to said surface;

a recess defined within said region to be cooled, wherein said recess includes an inner face;

at least one support projection extending from said inner face, wherein said at least one support projection includes a free end; and a cover coupled to said region to be cooled of said turbine component body, such that an inner surface of said cover is coupled to said free end of said at least one support projection, such that at least one cooling fluid passage is defined within said region to be cooled.

19. A system in accordance with claim 18, wherein said recess comprises:

said inner face extending from a tip of a trailing-edge region to a location spaced a distance from said trailing-edge tip; and a shoulder defined at said location spaced a distance from said trailing-edge tip.

20. A system in accordance with claim 18, wherein said system comprises at least one of a bond coat and a thermal barrier coat coupled to said cover.

* * * * *